United States Patent [19]

Cawley

[11] Patent Number: 4,532,102

[45] Date of Patent: Jul. 30, 1985

[54] PRODUCING TRITIUM IN A HOMOGENOUS REACTOR

[75] Inventor: William E. Cawley, Richland, Wash.

[73] Assignee: The United States of America as represented by the United States Department of Energy, Washington, D.C.

[21] Appl. No.: 500,107

[22] Filed: Jun. 1, 1983

[51] Int. Cl.[3] ..... G21G 1/02; G21C 1/24

[52] U.S. Cl. ..... 376/185; 376/189; 376/356; 376/358; 423/249

[58] Field of Search ..... 423/249; 376/185, 189, 376/306, 356–358

[56] References Cited

U.S. PATENT DOCUMENTS

| | | | |
|---|---|---|---|
| 2,908,621 | 10/1959 | Segrè et al. | 376/356 |
| 2,991,236 | 7/1961 | Vernon | 376/356 |
| 2,999,057 | 9/1961 | Hibshman | 376/356 |
| 3,037,922 | 6/1962 | Johnson | 376/189 |
| 3,505,017 | 4/1970 | Roth | 423/249 |
| 4,173,620 | 11/1979 | Shimizu | 423/249 |
| 4,190,515 | 2/1980 | Butler et al. | 423/249 |

FOREIGN PATENT DOCUMENTS

| | | | |
|---|---|---|---|
| 2065955 | 7/1981 | United Kingdom | 376/189 |

OTHER PUBLICATIONS

McLain et al., *Reactor Handbook*, pp. 722–765, Interscience Publishers (1961) New York.

Etherington, *Nuclear Engineering Handbook*, pp. 13–49 to 13–79, McGraw-Hill Book Company, Inc. (1958) New York.

*Primary Examiner*—Edward A. Miller

*Attorney, Agent, or Firm*—Robert Southworth, III; Judson R. Hightower

[57] ABSTRACT

A method and apparatus are described for the joint production and separation of tritium. Tritium is produced in an aqueous homogenous reactor and heat from the nuclear reaction is used to distill tritium from the lower isotopes of hydrogen.

2 Claims, 1 Drawing Figure

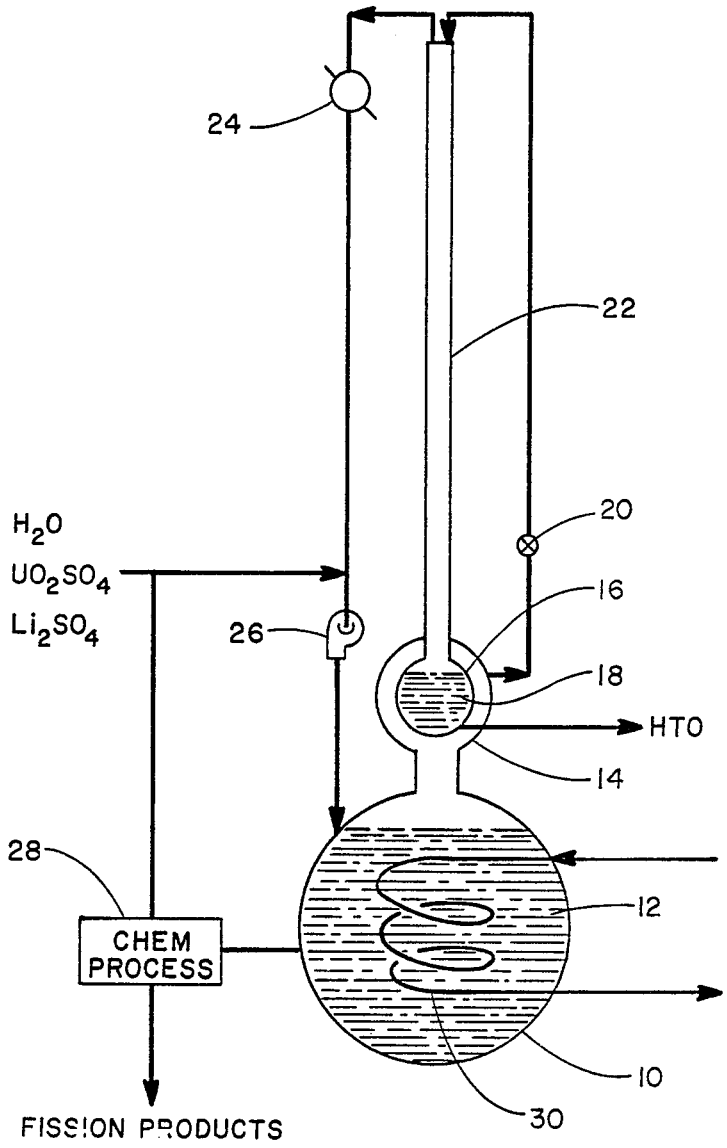
FIG.

PRODUCING TRITIUM IN A HOMOGENOUS REACTOR

The U.S. Government has rights in this invention.

BACKGROUND OF THE INVENTION

The invention relates generally to the production of tritium and, more particularly to a method and apparatus for the production of tritium in an aqueous homogenous nuclear reactor.

Tritium, by itself or in combination with deuterium, has been proposed as a fuel for thermonuclear or fusion reactors. Although deuterium is available in nature, tritium must be manufactured by transmutation of other elements. Tritium is commonly made by irradiating lithium-6 targets in a fission-type nuclear reactor. This has the disadvantage that, because of its short half-life, a significant amount of the tritium will decay before it can be recovered from the irradiated targets.

If one attempts to shorten this recovery time by manufacturing the tritium in a homogenous reactor, one may create a further problem of separating the tritium from the lighter isotopes of hydrogen with which it may become mixed.

It is, accordingly, a general object of the invention to provide a method for production of tritium which allows for the immediate and continuous recovery of the tritium.

It is a further object of the invention to provide a method and apparatus which will separate the generated tritium from the lower isotopes of hydrogen.

Other objects, advantages, and novel features of the invention will be apparent to those of ordinary skill in the art upon examination of the following detailed description of a preferred embodiment of the invention and the accompanying drawings.

SUMMARY OF THE INVENTION

A method and apparatus are provided for the joint production and separation of tritium. Tritium is produced in an aqueous homogenous reactor and heat from the nuclear reaction is used to distill tritium from the lower isotopes of hydrogen.

BRIEF DESCRIPTION OF THE DRAWING

The FIGURE is a diagrammatic view of an tritium producing and separating apparatus according to the present invention.

DESCRIPTION OF A PREFERRED EMBODIMENT

Turning now to the FIGURE, an apparatus for both the production and separation of tritium is illustrated. Tritium is produced in a homogenous aqueous reactor 10 by bombardment of lithium-6 with neutrons from a self-sustaining neutron chain reaction in the aqueous reactor fuel 12 held in the reactor in aqueous solution. The reactor 10 is a generally liquid tight vessel which is preferably in a spherical shape to minimize the loss of neutrons from the area of the reaction. Not shown for simplicity are conventional elemens such as surrounding neutron reflectors or control rod elements. The reactor fuel is an aqueous solution of a fissile material such as $U^{235}O_2SO_4$ and a target material such as $Li_2^6SO_4$. A neutron chain reaction is initiated in the solution when a critical mass is placed within the reactor. Because of the large negative power coefficient of reactivity in this type of reactor, the reaction is self controlling. Neutrons from the chain reaction also react with the $Li^6$ thereby forming tritium. The relative concentrations of $U^{235}$ and $Li^6$ may be adjusted so that the fuel remains at critical mass. In the interest of greater fuel economy, the aqueous media employed may actually be heavy water ($D_2O$) instead of ordinary light water. This conveys an additional benefit in that many of the end uses of tritium actually require a deuterium-tritium mixture. In this event, the separation process may be designed to yield the desired deuterium-tritium mixture.

As the nuclear reaction progresses, the aqueous fuel heats up and the aqueous component (including the tritium) tends to boil or evaporate. These heated vapors are collected in a chamber 14, which in turn is in contact with a distillation drum 16. The vapors give up heat to the distillation drum, condense, and are returned to the reactor. The distillation drum contains solution 18 enriched in the desired product, either HTO or DTO. As the solution in the distillation drum boils, the HTO or DTO tends to remain as $H_2O$ tends to evaporate.

A portion of the heated vapors in chamber 14 are passed through a pressure reduction valve 20 and thence to the top of distillation tower 22. In this tower, the condensing vapors from chamber 14 pass countercurrently with the vapors from distillation drum 16 thereby stripping the product from the overhead stream which then passes through a heat exchanger 24 where it is cooled before being returned to the reactor by pump 26.

From time to time a sidestream may be withdrawn from the reactor and conventional chemical processing 28 may be used to clean fission products from the reactor fuel. Thus neutron poisons may be continuously removed from the reactor so that as many neutrons as possible from the nuclear chain reaction may be employed in making tritium.

The nuclear reaction is self-regulating in this type of reactor (that is, the reaction only occurs as rapidly as heat is withdrawn from the system). To speed up the reaction, additional heat may be withdrawn using cooling coils 30.

The foregoing description of a preferred embodiment of the invention has been presented for purposes of illustration and description and is not intended to be exhaustive or to limit the invention to the precise form disclosed. It was chosen and described in order to best explain the principles of the invention and their practical application to thereby enable those skilled in the art to best utilize the invention in various embodiments and with various modifications as are suited to the particular use claimed. It is intended that the scope of the invention be defined by the claims appended hereto.

I claim:

1. A method for producing tritium comprising:

(a) placing a fuel solution in an aqueous homogenous nuclear reactor, said fuel solution consisting essentially of an aqueous solution of $UO_2SO_4$ and $Li_2^6SO_4$;

(b) causing a neutronic chain reaction to occur in said fuel solution;

(c) reacting said $Li_2^6SO_4$ with neutrons from said chain reaction to produce tritium;

(d) operating a distillation column with heat produced by said chain reaction; and (e) stripping with said distillation column said tritium in the form of tritiated water from said aqueous fuel.

2. The method of claim 1 wherein said fuel solution consists essentially of $D_2O$ as the aqueous portion thereof and said tritium is contained in a DTO product.

* * * * *